United States Patent [19]

Salomon

[11] 4,185,851

[45] Jan. 29, 1980

[54] PIVOTING SAFETY BINDING FOR SKI

[75] Inventor: Georges P. J. Salomon, Annecy, France

[73] Assignee: Etablissements Francois Salomon et Fils, Annecy, France

[21] Appl. No.: 830,243

[22] Filed: Sep. 2, 1977

[30] Foreign Application Priority Data

Sep. 3, 1976 [FR] France ..... 76 26687

[51] Int. Cl.[2] ..... A63C 9/08

[52] U.S. Cl. ..... 280/613; 280/633; 280/634

[58] Field of Search ..... 280/613, 618, 617, 620, 280/636, 611, 634, 633, 607; 36/117

[56] References Cited

U.S. PATENT DOCUMENTS

| | | | |
|---|---|---|---|
| 2,793,869 | 5/1957 | Braun | 280/623 |
| 3,210,090 | 10/1965 | Keeling et al. | 280/620 |
| 3,610,648 | 10/1971 | Reese, Jr. | 280/620 |
| 3,918,732 | 11/1975 | Wulf | 280/618 |
| 3,931,980 | 1/1976 | Marker | 280/613 |
| 3,950,000 | 4/1976 | Sittmann | 280/636 |
| 4,077,653 | 3/1978 | Beyl | 280/620 |

FOREIGN PATENT DOCUMENTS

| | | | |
|---|---|---|---|
| 1428907 | 5/1969 | Fed. Rep. of Germany | 280/618 |

*Primary Examiner*—Joseph F. Peters, Jr.
*Assistant Examiner*—Milton L. Smith
*Attorney, Agent, or Firm*—Pollock, Vande Sande & Priddy

[57] ABSTRACT

In a ski binding, a plate integral with a ski boot, at least temporarily, comprises a space cooperating with a pivot block secured to the ski, the plate and pivot being caused to cooperate by releasable retention means. A pin, integral with the plate, engages, when the ski is being fitted, in a housing in the pivot block and is secured therein by a deformable resilient locking means which allows the plate to rotate in relation to the ski, but prevents the pin from escaping from the housing in a vertical direction. The invention is applicable in particular to pivoting bindings known as rotational fittings.

15 Claims, 12 Drawing Figures

1
4
3
2a
13
16
14
2
5
7
9
6
S
11
5
15
12

8
Y
7
22
18
13
20
12
X
F
X'
11
15
14
17
9
10
21
19
6
Y'

39
30
38
40
37

42
12
41
40
12

PIVOTING SAFETY BINDING FOR SKI

The present invention relates to safety bindings designed to hold a boot to a ski while permitting the boot to be freed in the event of a safety release.

It relates more particularly to safety bindings which provide lateral fitting, and possibly safety release, by a rotational movement of the foot upon the ski.

The bindings covered by the invention are of the type usually known as "pivoting," in which the ski and the boot (or a plate temporarily attached thereto) cooperate by means of a pivot located under the sole of the foot. This type of binding is more often used in conjunction with a plate fitted under the boot, in which case the safety release takes place between the plate and the ski. When it is desired to ski, the plate is locked to the ski by retention means adapted to be released against the action of a resilient element. The fact of a pivot being located under the sole of the foot increases safety, especially in the event of a lateral release, since the pivot imparts a very definite trajectory to the boot. In these known bindings, the pivot may be located either upon the plate, in which case it cooperates with a housing arranged in a block integral with the ski; or upon the ski, in which case the housing designed to accommodate it is arranged in the plate.

This type of binding may be fitted either by (a) engaging one end of the foot, located upon the longitudinal axis of the ski, by lowering the boot vertically to cause the pivot to enter its housing; or (b) by first engaging the pivot in its housing, by a vertical movement of the foot placed at an angle in relation to the ski, and by then rotating the foot to coincide with the longitudinal axis of the ski.

Swiss Pat. No. 558,187 describes a pivoting device of this kind, with which fitting is by rotation.

When fitting is carried out in accordance with the second of the two methods mentioned above, known pivoting bindings have certain disadvantages, since the skier must be extremely careful how he places his foot in relation to the ski. If, for example, the lower surface of the boot (or of the intermediate plate) forms an angle with the upper surface of the ski, fitting will be unsatisfactory or impossible. Furthermore, there is always a risk of the pivot coming out of its housing during the rotational movement and before the boot is locked in relation to the ski. It will be understood that it is difficult to meet these conditions since:

(a) with this type of binding, the pivot is located under the sole of the skier's foot, which means that the procedure must be carried out by touch:

(b) snow or mud often adhere unevely to the sole of the boot;

(c) in most cases, the ski must be fitted after a safety release following a fall on a more or less steep ski slope.

It is an object of the present invention to overcome the disadvantages of pivoting bindings requiring fitting by rotation of the foot, in order to make fitting faster, easier, and more reliable. To this end, and according to the present invention, once the pivot is positioned in its housing, it is held there, and there is no danger of it coming out again unless the skier so desires.

As in the case of known bindings, the binding according to the present invention comprises:

(1) retention means adapted to be released against the action of a resilient element and assuring that the boot remains along the longitudinal axis of the latter, the retention means being, as a general rule, located under the skier's foot and consisting of locking elements secured partly to the ski and partly to the boot; and (2) means for pre-positioning the boot upon the ski prior to locking, the means being in the form of complementary profiles pertaining to the ski and to the boot respectively and facilitating the rotational movement of the foot from a position in which the boot is at an angle in relation to the ski.

According to the invention, the binding is characterized in that the pre-positioning means are kept engaged with each other by a resilient locking system offering resilient opposition to separation of the profiles. It will be understood that, with an arrangement of this kind, the complementary profiles, for example a pivot and its housing, will remain in engagement in such a manner that the pivot will be prevented from leaving the housing, but will not interfere with the rotation of the foot to permit locking in the axial position.

This locking system is preferably such that it is not powerful enough to interfere with a safety release, while still allowing the skier to carry the ski along when he lifts his foot.

The resilient locking system is preferably mounted in one of the complementary profiles and cooperates with a snap-in stop in the other profile. It is also possible for the locking system to be mounted in the housing or to be associated with the pivot, regardless of whether the pivot is integral with the boot or the ski. If necessary, the locking system may also be arranged to provide a connection between the profiles:

(a) either without any play, except of course for their ability to rotate in relation to each other; in this case, the profiles will be an exact fit in order to prevent any movement in the plane of the ski;

(b) or with play in the plane of the ski, if the profiles are of different dimensions, for example if the opening in the housing is definitely larger than the diameter of the pivot.

Moreover, the locking system may be arranged to provide a connection between the complementary profiles only when the boot is not held to the ski by releasable means of retention.

The advantage of this arrangement is that the locking system does not come into action in the event of a safety release. It is obvious, however, that there is nothing to prevent the locking system from effecting a connection between the complementary profiles, even when the boot is held axially, in which case it will be sufficient to adjust the releasable retention means, bearing in mind the action of the locking system.

A description will now be given of several embodiments of the invention, with reference to the drawings attached hereto, wherein.

Generally speaking, the embodiments illustrated have an intermediate plate attached temporarily under the boot, the safety release occurring between the plate and the ski.

The boot is held to the plate by conventional means, in such a manner that these two elements function as a single block. It would, of course, be possible, without departing from the scope of the invention, to eliminate the intermediate plate and for releases to be effected directly between the boot and the ski.

Also provided, according to the invention, is an arrangement of the complementary profiles such that the male profile is attached to the boot and the female profile to the ski, but the reverse would also be possible, the male profile being secured to the ski and the female profile to the boot.

Figure 1:
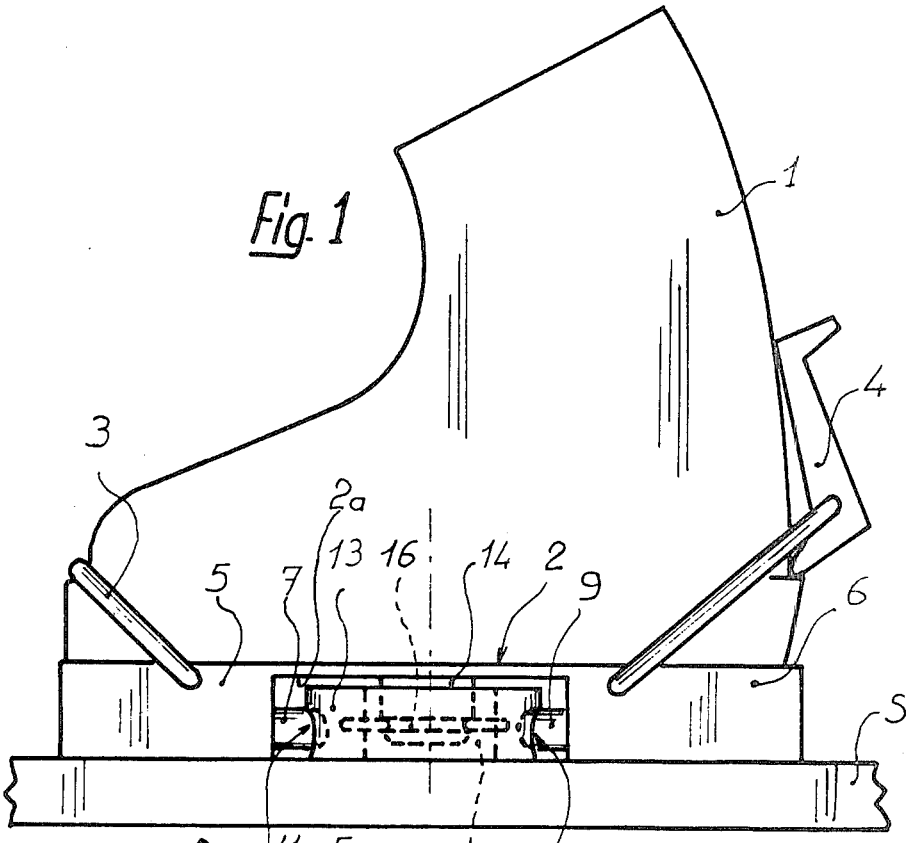
FIG. 1 is a side elevation of a pivoting binding, equipped with a locking system, according to a first embodiment, the binding being shown in the position in which the boot is locked.

In FIG. 1, 1 is a boot to the bottom of which is attached a plate 2 which is thus integral therewith. The front 3, and rear 4, attachment systems are known per se and will not be described in detail since they are not a part of the invention. It is sufficient to indicate that attachments 3 and 4 are detachable, in order to allow the boot to be separated from the plate when these components are not in use for skiing.

In this structure, safety releases occur between plate 2 and ski S, so that, in the event of a fall, both the boot and the plate are released and remain attached to each other.

Secured to the upper surface of ski S, and on the longitudinal axis XX' thereof, for example by means of screws, is a block 13 which cooperates with a depression 2*a* in the lower surface of plate 2 and in an area corresponding substantially to the sole of the skier's foot. This depression 2*a* which, in the embodiment illustrated, is a cut-out opening laterally in the sides of the plate, is higher and longer than block 13. Located on each side of depression 2*a* are front and rear plate housings 5 and 6, the lower surfaces of which rest upon the ski. Accommodated in housings 5 and 6, respectively (see FIG. 2) are pistons 7 and 9 which are in alignment with longitudinal axis Y—Y' of the plate and are caused by springs 8 and 10 to project into the interior of depression 2*a*. These pistons, in conjunction with corresponding housings 11, 12, arranged in block 13 on longitudinal axis X—X' of the ski, constitute the locking elements for the means of holding the boot to the ski. In the locked position (see FIG. 1), pistons 7,9 are engaged in housing 11,12, thus assuring that the boot is retained in the axial position.

The binding comprises pre-positioning means which, by their cooperation, also impose a specific trajectory to the boot in the event of a lateral release, these means being in the form of complementary profiles, namely:

(1) a pin 14 extending into the interior of depression 2*a* from the upper surface thereof and running at right angles to the lower surface of the plate, along longitudinal axis Y—Y' thereof; and (2) a housing 15 arranged in block 13 on the longitudinal axis X—X' of the ski.

Pin 14 is preferably located half-way between plate housing 5,6, while housing 15 is at the center of block 13. The housing is preferably elongated along the longitudinal axis of the ski, and its width permits an adjustment with the pivot.

Figure 2:
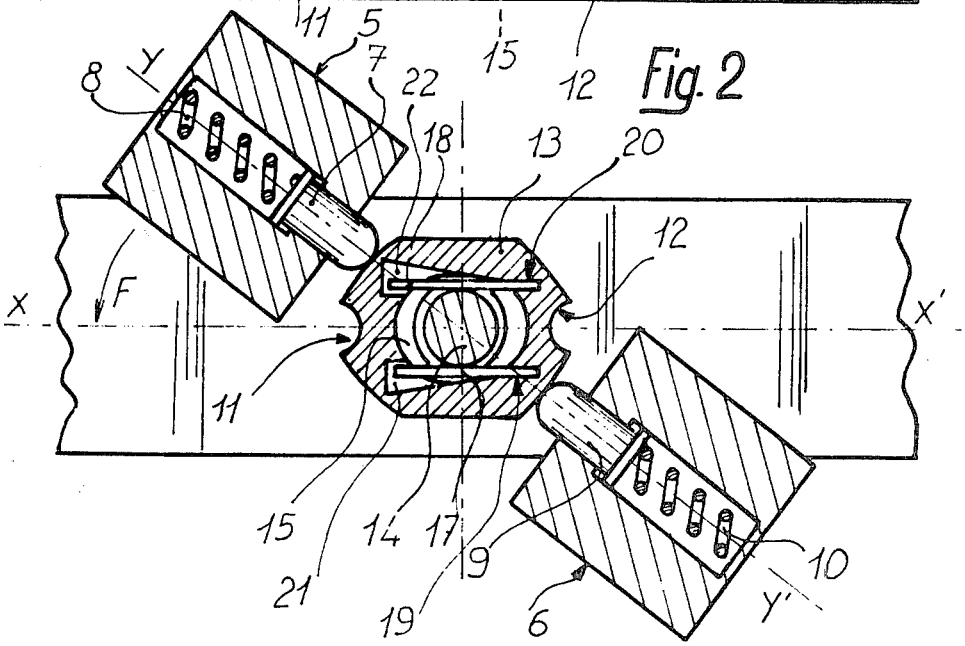
FIG. 2 is a plan view, in section, of FIG. 1, shown while the ski is being fitted.

With this type of binding, refitting the ski after a safety release is necessarily effected by first of all engaging pin 14 in housing 15, the boot being at this time at an angle to the longitudinal axis of the ski, as shown in FIG. 2; whereupon the foot is rotated in the direction of arrow F in order to align plate 2 with the longitudinal axis of the ski. The locked position is achieved when pistons 7,9 are engaged in their respective housing 11,12.

The pin is prevented from coming out of its housing by a resilient locking system offering resilient resistance to separation of the pin and its housing once they have been engaged with each other in the position shown in FIG. 1. This locking system consists of a circular groove 16 around the periphery of the free end of pin 14; and two springs 17, 18 (for example steel rods capable of resilient deformation), ends 19,20 of the rods being housed and firmly held in block 13, whereas the other ends are free to move in cavities 21,22 which are arranged in block 13 and run parallel with the plane of the ski.

In the embodiment illustrated, spring rods 17,18 are parallel with each other and horizontal. The space between them is substantially equal to the diameter of groove 16 in pin 14, so that when the latter is engaged in housing 15, the two springs move apart to allow the end of the pin to pass and then return to their normal position, as shown in FIG. 2, to engage in groove 16. It will be understood that this arrangement allows pin 14 to rotate about its axis, but that it requires a specific effort on the part of the skier to withdraw the pin from its housing, and this prevents any inopportune withdrawal.

Finally it will be noted, and this is especially visible in FIG. 2, that the dimensions of housing 15, along the longitudinal axis, are distinctly larger than the diameter of the pin, thus allowing the latter to move in the direction of longitudinal axis X—X' of the ski. Thus the connection between the pin and its housing has a certain amount of longitudinal play.

Figure 3:
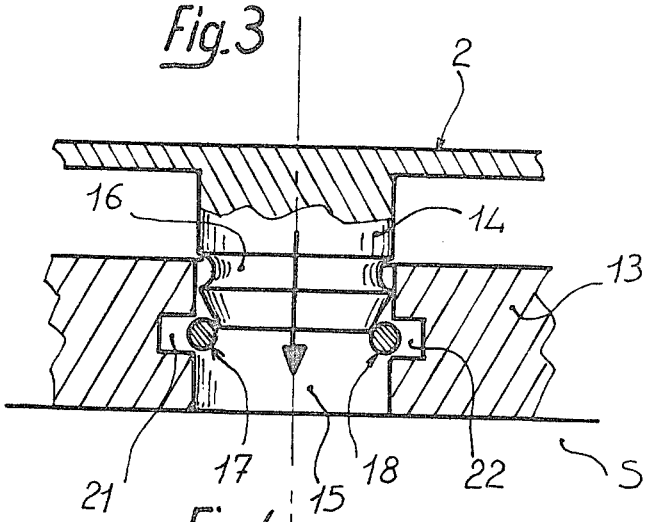
FIGS. 3 and 4 are details, to an enlarged scale and in section, of the locking system in FIGS. 1 and 2, showing the position before engagement and after engagement respectively.
Figure 4:
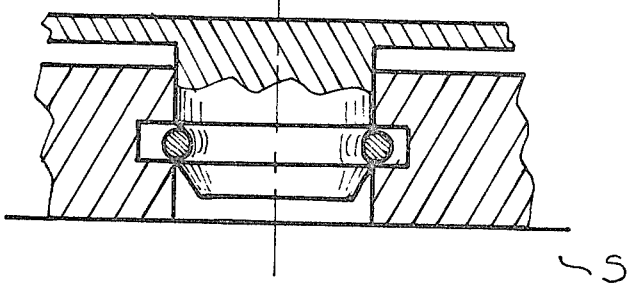

FIGS. 3 and 4 show how pin 14 engages between spring rods 17,18 and is held there in the vertical direction.

Figure 5:
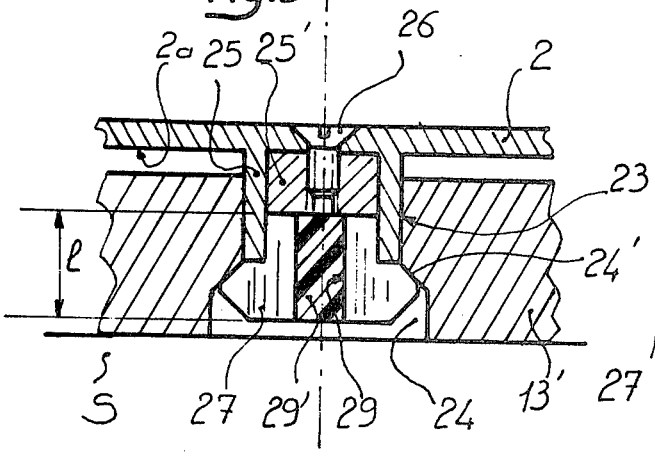
FIG. 5 is a vertical section through a second embodiment of a locking system according to the invention.
Figure 6:
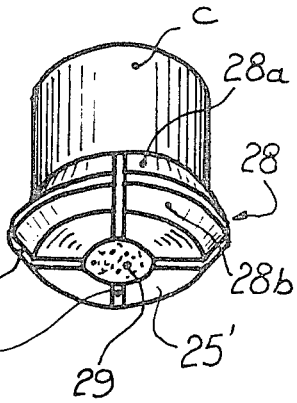
FIG. 6 is a perspective view of a pivot equipped with the locking system according to FIG. 5.

FIGS. 5 and 6 show another embodiment of the locking system. In this case, housing 23 in central block 13', secured to ski S, has an enlargement 24 at its lower end which forms a stop shoulder 24', the pin being in the form of a hollow sleeve 25 projecting from the lower surface of depression 2*a* in plate 2. Mounted within sleeve 25 is a part 25' secured by a screw 26. This part, which is shown in perspective in FIG. 6, may be made of plastic, for example, and is in the form of a solid body C having a skirt, marked in general 28, in the form of claws separated by slots 27, the length l of the claws being enough to allow them to deform resiliently. The outer wall of the claws is in the form of a double cone 28*a*,28*b*, lower cone 28*b* facilitating the introduction of part 25' into the housing, whereas upper cone 28*a* is designed to bear against a similarly shaped stop 24' in housing 24, for the purpose of snapping the pin into its housing. In order to impart additional resiliency to the pin, it may be desirable to fit a resilient cylindrical element 29', made of rubber, for example, in central area 29 defined by the claws.

Figure 7:
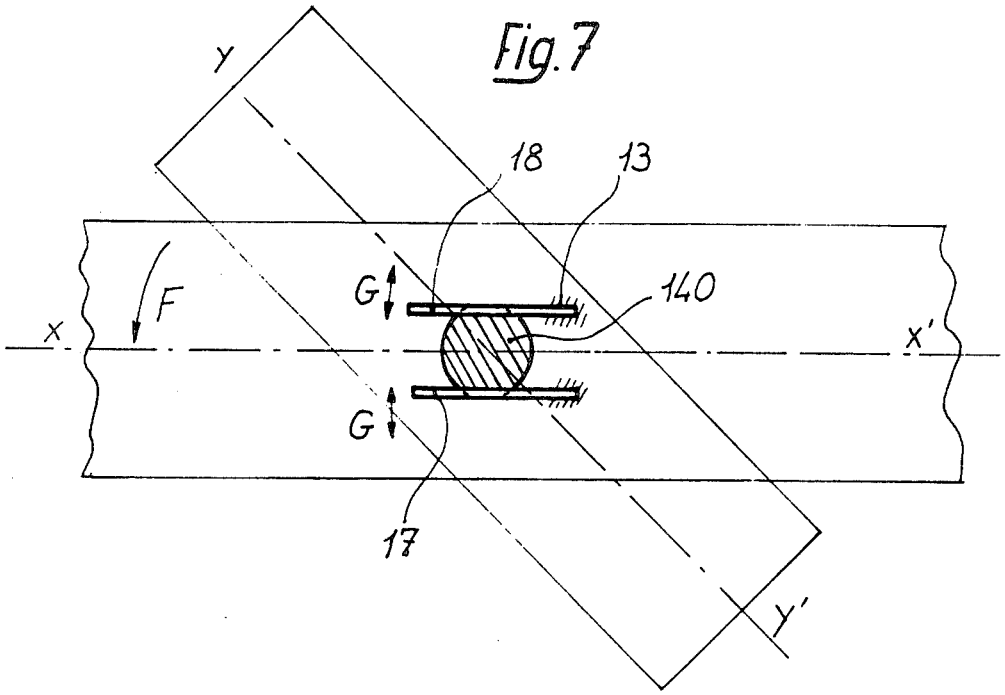
FIGS. 7, 8, 9 illustrate diagrammatically, in section and in broken-away perspective, a third embodiment of a locking system according to the invention.
Figure 8:
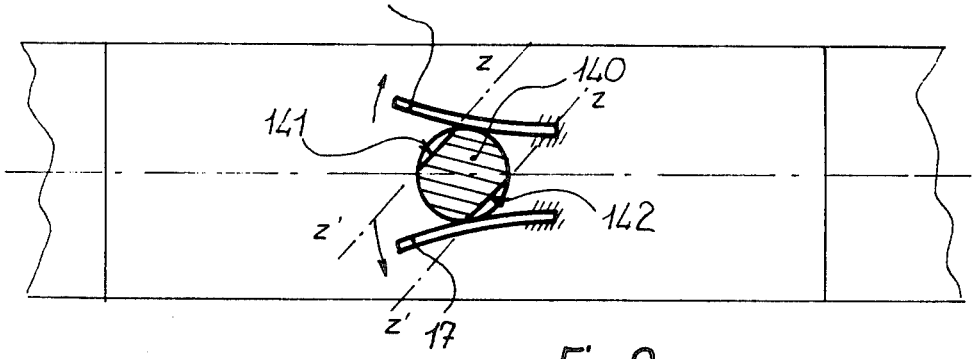
Figure 9:
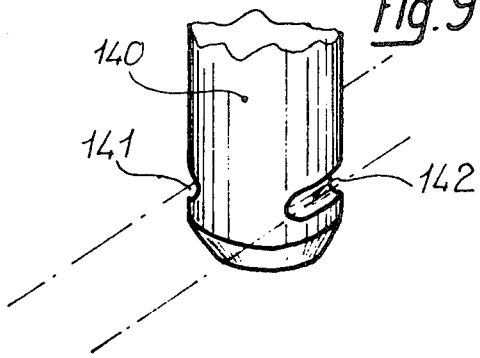

FIGS. 7,8 and 9 illustrate a variant of the invention which differs from the preceding embodiments in that the locking system snaps in only when the boot is not on the longitudinal axis of the ski. As in the case of FIGS. 1 to 4, two spring rods 17,18, in the housing in block 13 secured to the ski, have one end secured to the block while the other ends are free to move in the direction of double arrows G in FIG. 7. Moreover, pin 140, integral with plate 2, instead of having a continuous peripheral groove as in FIGS. 1 to 4, has two diametrically opposed grooves 141,142 in a plane parallel with the lower surface of plate 2. It should be pointed out that grooves 141,142 run in the general direction Z—Z' not coinciding with longitudinal axis Y—Y' of the plate (see FIG. 7). Thus when pin 140 is engaged in its housing, at the start of the operation of fitting the ski, with the boot at an angle to the ski as shown in FIG. 7, spring rods 17,18 snap into grooves 141,142. Although this continues at the beginning of the rotational movement of the boot in the direction of arrow F, it ceases when the boot is on the longitudinal axis of the ski, as shown in FIG. 8 since, at this time, rods 17,18 bear against the cylindrical external surface of pin 140 and are separated, as shown by the arrows in FIG. 8. This design has the advantage of not interfering with vertical release of the binding since, in the event of a vertical release with the boot in position shown in FIG. 8, rods 17,18 in no way oppose the release of pin 140 from its housing.

Figure 10:
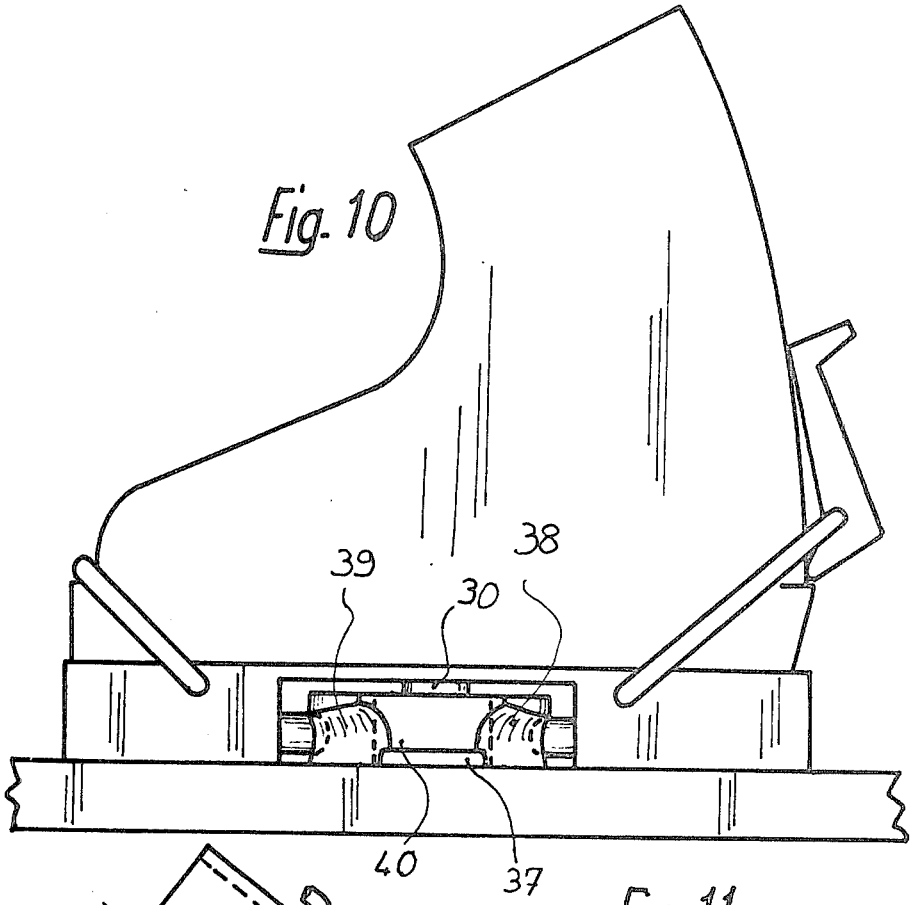
FIGS. 10, 11, 12 illustrate a fourth embodiment of the invention, FIG. 10 being a side elevation of the binding as a whole, FIG. 11 being a plan view without the boot, and FIG. 12 being a section, to an enlarged scale, along the line 12—12 in FIG. 11.
Figure 11:
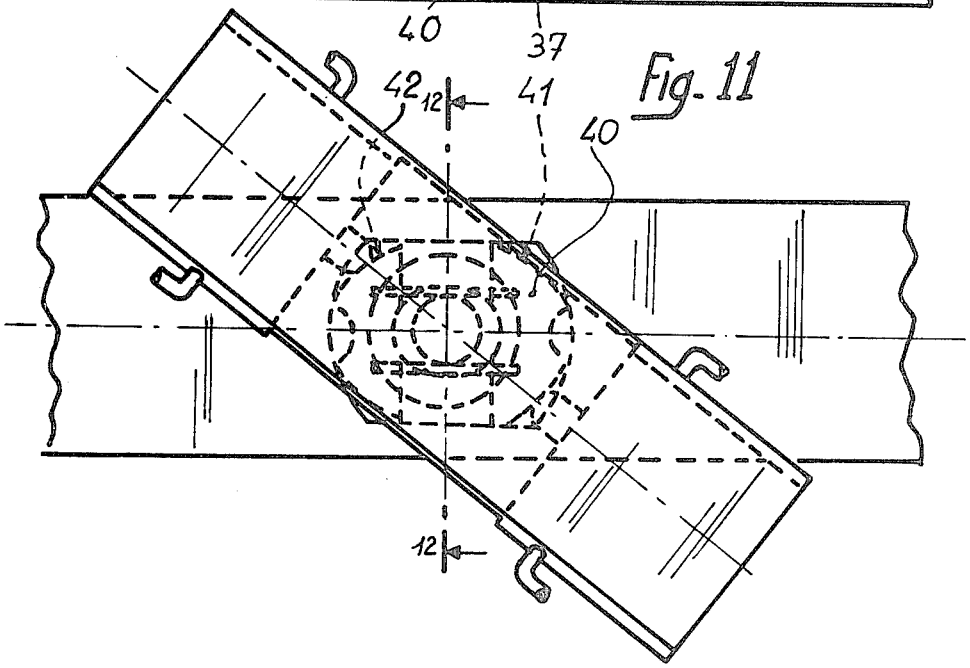
Figure 12:
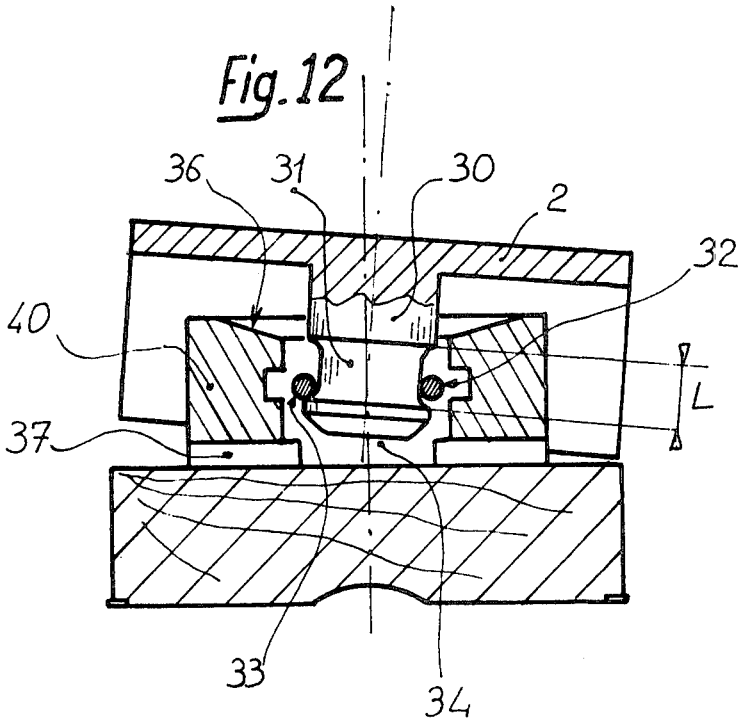

In the foregoing embodiments, the pin is held laterally in the relevant oblong housing and there is no play in the snap-in attachment, i.e. spring rods 17,18 are a perfect fit in the continuous or discontinuous grooves in the pin. However, it would also be possible for the pin to be able to move in its housing at right angles to longitudinal axis X—X' of the ski. This variant is illustrated in FIGS. 10,11 and 12.

In order to provide for a certain amount of play in the snap-in attachment, the height of groove 31 in pin 30 (L in FIG. 12) is greater than the diameter of spring rods 32,33 mounted in housing 34 in block 40.

The width of housing 34 is greater than the diameter of pin 30. This allows plate 2, integral with the pin, a certain amount of mobility, especially at right angles to the longitudinal axis of the ski. This mobility, however, in no way interferes with the retention of pin 30 in its housing.

Central block 40 also has characteristics which facilitate still further the fitting of the ski. For instance, housing 34 has a conical mouth 36 which makes it easier to insert and center the pin in housing 34. Moreover, removal of any snow accumulating in housing 34 is made possible by the provision of a transverse passage 37 in the base of block 40, which provides communication between housing 34 and the outside.

Finally, and as shown more particularly in FIGS. 10,11,12, since play L between the pin and its housing, in the locked position, allows plate 2 to move into a position not parallel with the plane of the ski, guide ramps 38,39,41 for fitting the ski may be arranged on the periphery of block 40.

The vertical play in the locking mechanism defined by the dimension L (FIG. 12) is such that plate-retaining pistons 7,9 are compulsorily engaged with the guide ramps when the ski is being fitted.

Finally, it should be noted that, in the embodiments illustrated herein, the housing into which the pin is inserted is oblong, with its major axis in the direction of the length of the ski. However, this is not essential. For instance, the housing could be circular and could be fitted, or not, to the pin.

What is claimed is:

1. A safety binding for a ski boot, permitting lateral fitting by a rotational movement of the foot upon the ski, comprising (a) releasable retention means assuring retention of the boot in the longitudinal direction of the ski, said retention means having first locking means secured to the boot and second locking means secured to the ski, each of said first and second locking means being constituted by at least two elements spaced from one another, said elements of one of said locking means being in the form of sockets and said elements of the other said locking means being in the form of rods, at least one of said rods being urged by a resilient element; said rods penetrating in said sockets for locking said boot upon said ski; and (b) means for pre-positioning the boot upon the ski prior to locking, said means being in the form of complementary profiles associated with the ski and with the boot, respectively, and facilitating the rotational movement of the boot from a position in which the boot is at an angle to the ski; said profile associated with the ski being located between the elements constituting the locking means secured to the ski and said profile associated with the boot being situated between the elements constituting the locking means secured to the boot; said complementary profiles of said prepositioning means being kept in rotatable engagement with each other by a resilient coupling system offering resilient opposition to the separation of said profiles.

2. A binding according to claim 1, wherein said resilient coupling system is mounted in one of said complementary profiles and cooperates with a snap-in stop in the other complementary profile.

3. A binding according to claim 1, wherein said profiles are of different dimensions, allowing a certain amount of play in a plane parallel with the plane of the ski.

4. A binding according to claim 1, wherein said complementary profiles consist of a pin and a housing, said pin extending at right angles to the plane of the ski and of the sole of the boot, said resilient coupling system being housed in a cavity in said housing, said pin comprising a snap-in stop in which said coupling system engages when said pin enters said housing.

5. A binding according to claim 4, wherein said coupling system consists of at least one resiliently deformable spring rod arranged in a plane at right angles to said pin, one end of said rod being fixed relative to said housing while the other end is free to move.

6. A binding according to claim 4, wherein said coupling system consists of two spring rods, one end of each rod being held in the wall of the housing while the other end of each rod is free to move in a cavity in the wall of said housing said rods being parallel to one another.

7. A binding according to claim 6, wherein said pin comprises a peripheral groove in which said spring rods are designed to engage.

8. A binding according to claim 6, wherein said pin comprises two diametrically opposite grooves extending in a plane at right angles to the axis of said pin.

9. A binding according to claim 8, wherein said grooves in said pin are parallel and transverse to the longitudinal axis of said ski or said boot carrying it, so that said spring rods are engaged in said grooves as long as the boot is not on the longitudinal axis of the ski, whereas said rods are released from said grooves when the boot is in the axial position.

10. A binding according to claim 4, wherein in the vicinity of the sockets constituting one of said locking means is provided a system of guide ramps for guiding the rods comprising said second locking means towards said sockets when the boot is being fitted on the ski, said pin comprising means engaged with said resilient coupling system and allowing retention with axial displacement of said pin in said housing, said displacement being such that the rods comprising said second locking means are in compulsory engagement with said guide ramps.

11. A binding according to claim 1, wherein said complementary profiles consist of a pin and a housing, said pin extending at right angles to the plane of the ski and of the sole of the boot, said resilient coupling system being associated with said pin and said housing having a snap-in stop in which said coupling system engages when said pin enters said housing.

12. A binding according to claim 11, wherein said coupling system consists of a resiliently deformable skirt secured to said pin and urged to expand, said skirt engaging under a shoulder in said housing after said pin has been introduced by deforming said skirt.

13. A binding according to claim 12, wherein the lower end of said skirt is conical to facilitate introduction into said housing.

14. A binding according to claim 13, wherein said skirt is in the form of claws separated from each other when they are expanded by a resilient central element.

15. A binding according to claim 1, wherein said first and second locking means are disposed in a zone below the boot.

* * * * *